US007665964B2

(12) United States Patent
Taylor et al.

(10) Patent No.: US 7,665,964 B2
(45) Date of Patent: Feb. 23, 2010

(54) TURBINE

(75) Inventors: Mark D Taylor, Derby (GB); Neil W Harvey, Derby (GB); Martin G Rose, Zurich (CH)

(73) Assignee: Rolls-Royce plc, London (GB)

( * ) Notice: Subject to any disclaimer, the term of this patent is extended or adjusted under 35 U.S.C. 154(b) by 562 days.

(21) Appl. No.: 11/176,348

(22) Filed: Jul. 8, 2005

(65) Prior Publication Data

US 2006/0034689 A1 Feb. 16, 2006

(30) Foreign Application Priority Data

Aug. 11, 2004 (GB) ..... 0417834.9

(51) Int. Cl.
*F01D 1/10* (2006.01)

(52) U.S. Cl. ..... 415/194; 415/208.2

(58) Field of Classification Search ..... 415/193, 415/194, 198.1, 199.5, 208.1, 208.2, 211.2, 415/220
See application file for complete search history.

(56) References Cited

U.S. PATENT DOCUMENTS 2,435,236 A * 2/1948 Redding ..... 415/194
4,023,350 A * 5/1977 Hovan et al. ..... 60/39.5
4,076,454 A * 2/1978 Wennerstrom ..... 415/208.2
4,208,167 A * 6/1980 Yasugahira et al. ..... 415/191
4,662,820 A 5/1987 Sasada
4,844,692 A * 7/1989 Minkkinen et al. ..... 415/208.1
5,489,186 A * 2/1996 Yapp et al. ..... 415/208.3
6,544,001 B2 * 4/2003 Dailey ..... 416/97 R

FOREIGN PATENT DOCUMENTS

| | | |
|---|---|---|
| GB | 1 008 526 SP | 10/1965 |
| GB | 1 588 487 SP | 4/1981 |
| JP | 10 238 307 AB | 9/1998 |

OTHER PUBLICATIONS

Jet Propulsion: A Simple Guide to the Aerodynamic and Thermodynamic Design and Performance of Jet Engines, by Nicholas Cumpsty (2003), Chapter 9, pp. 94-107.

* cited by examiner

*Primary Examiner*—Richard Edgar
(74) *Attorney, Agent, or Firm*—Jeffrey S. Melcher; Manelli Denison & Selter PLLC

(57) ABSTRACT

A gas turbine engine turbine comprises an annular array of nozzle guide vanes and an annular array of turbine blades mounted within its annular casing. An array of radially extending protrusions are positioned axially upstream of said array of said nozzle guide vanes and protruding inwardly from the inner casing wall so as to mix the tangential momentum component of the overtip leakage fluid flow before it reaches the array of nozzle guide vanes.

13 Claims, 7 Drawing Sheets

TURBINE

FIELD OF THE INVENTION

This invention relates to a turbine. More particularly this invention is concerned with increasing the efficiency of a turbine of a gas turbine engine.

BACKGROUND OF THE INVENTION

An axial flow gas turbine engine generally comprises, in axial flow series, an air intake, a propulsive fan, an intermediate pressure compressor, a high pressure compressor, combustion equipment, a high pressure turbine, an intermediate pressure turbine, a low pressure turbine and an exhaust nozzle.

The turbines typically comprise a set of axially alternating stationary nozzle guide vanes and rotatable turbine blades. The nozzle guide vanes and turbine blades are mounted generally in a ring formation, with the vanes and the turbine blades extending radially outwardly. Gases expanded by the combustion process in the combustion equipment force their way into discharge nozzles where they are accelerated and forced onto the nozzle guide vanes, which impart a "spin" or "whirl" in the direction of rotation of the turbine blades. The gases impact the turbine blades, causing rotation of the turbine.

The torque or turning power applied to the turbine is governed by the rate of gas flow and the energy change of the gas between the inlet and outlet of the turbine blades.

A gap exists between the blade tips and casing, which varies in size due to the different rates of expansion and contraction of the blade and casing. To reduce the loss of efficiency through gas leakage across the blade tips, a shroud is often fitted. This consists of a small segment at the tip of each blade which together form a peripheral ring.

However, even with a fitted shroud, tip leakage reduces efficiency in a number of ways. Work is lost when the higher pressure gas escape through the tip clearance without being operated on in the intended manner by the blade (for compressors the leakage flow is not adequately compressed and for the turbines the leakage is not adequately expanded). Secondly, the leakage flow from the pressure side produces interference with the suction side flow. The difference in the orientation and velocity of the two flows results in a mixing loss as the two flows merge and eventually become uniform. Both types of losses contribute to reduction in efficiency.

The problem of tip leakage has been investigated for many years and no effective and practical solution has been found other than reducing the tip clearances. Most current solutions involve active changing of the tip clearance by adjusting the diameter of the engine case liner.

It has now been found through computational fluid dynamics (CPD) that the overtip leakage flow from the high pressure turbine also has an adverse effect of the intermediate pressure turbine vane inlet conditions and thereby reduces efficiency.

It is an object of the present invention to seek to improve the efficiency of a turbine.

It is a further object of the present invention to seek to address the adverse effects of over tip leakage on a turbine.

SUMMARY OF THE INVENTION

According to the present invention there is provided a turbine having a fluid inlet and a fluid outlet and arranged to pass fluid between the inlet and the outlet and comprising a plurality of axially alternating annular arrays of rotatable aerofoil members and fixed aerofoil members mounted within an annular casing having an inner wall and an outer wall, the inner wall of the casing being provided with an array of radially inwardly extending protrusions positioned axially between a selected one of said annular arrays of rotatable aerofoil members and an adjacent annular array of fixed aerofoil members, wherein the selected one of said annular arrays of rotatable aerofoil members is positioned upstream of said adjacent array of fixed aerofoil members.

Advantageously the positioning of the protrusions being axially upstream of the aerofoil members mixes the overtip leakage fluid flow from the annular array of rotatable of aerofoil members such that the tangential momentum component of the flow is reduced or removed before the flow reaches the adjacent annular array of fixed of aerofoil members.

Preferably the selected annular array of rotatable aerofoil members form part of the high-pressure turbine and/or the adjacent annular array of fixed aerofoil members form part of the intermediate-pressure turbine. Even more preferably the annular array of rotatable of aerofoil members are the last axial array of turbine blades in the high-pressure turbine and the adjacent annular array of fixed of aerofoil members are the first guide vanes of the intermediate-pressure turbine.

The annular array of rotatable of aerofoil members may have a blade and a tip. Preferably the tip is spaced from the inner casing wall a distance that is substantially similar to distance the protrusions extend radially from the inner casing wall.

A recess may be provided within the inner wall of the casing of said gas turbine engine, the recess extending radially from the inner wall of the casing towards the outer wall of the casing.

The tips of the first aerofoil members may be positioned within said recess.

DESCRIPTION OF THE DRAWINGS

The invention will now be described, by way of example only, with reference to the accompanying drawings in which.

Detailed Description of the Invention

Figure 1:
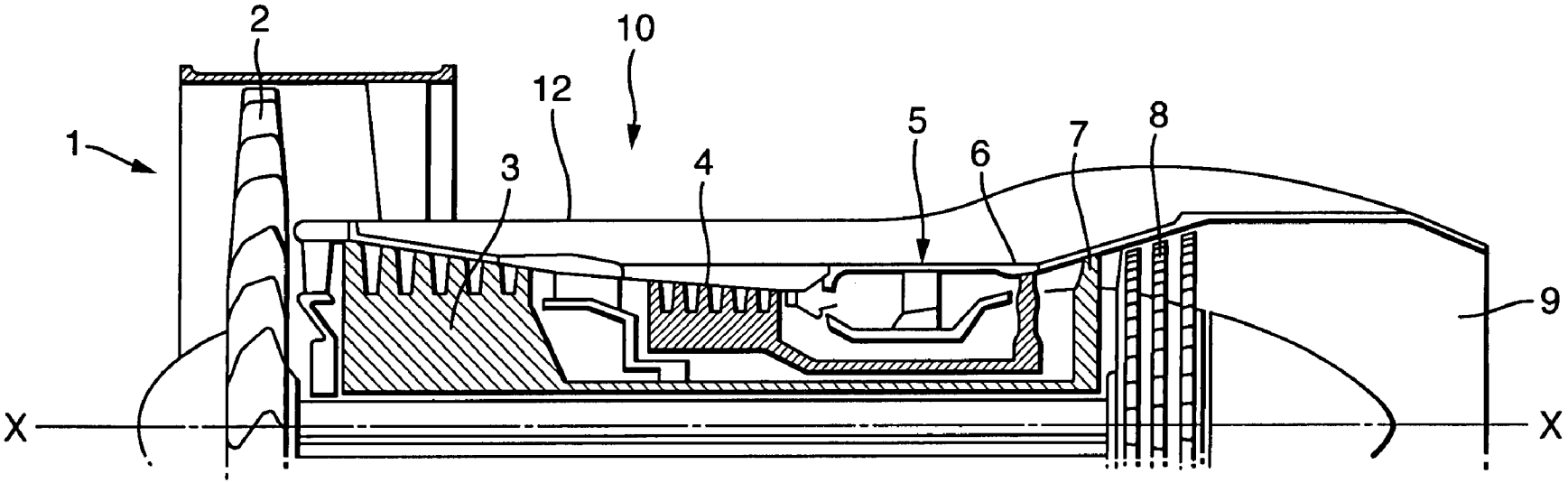
FIG. 1 is a schematic sectioned view of a ducted gas turbine engine

With reference to FIG. 1, a ducted fan gas turbine engine generally indicated at 10 comprises, in axial flow series, an air intake 1, a propulsive fan 2, an intermediate pressure compressor 3, a high pressure compressor 4, combustion equipment 5, a high pressure turbine 6, an intermediate pressure turbine 7, a low pressure turbine 8 and an exhaust nozzle 9.

Air entering the air intake 1 is accelerated by the fan 2 to produce two air flows, a first air flow into the intermediate pressure compressor 3 and a second air flow that passes over the outer surface of the engine casing 12 and which provides propulsive thrust. The intermediate pressure compressor 3 compresses the air flow directed into it before delivering the air to the high pressure compressor 4 where further compression takes place.

Compressed air exhausted from the high pressure compressor 4 is directed into the combustion equipment 5, where it is mixed with fuel and the mixture combusted. The resultant hot combustion products expand through and thereby drive the high 6, intermediate 7 and low pressure 8 turbines before being exhausted through the nozzle 9 to provide additional propulsive thrust. The high, intermediate and low pressure turbines respectively drive the high and intermediate pressure compressors and the fan by suitable interconnecting shafts.

Figure 2:
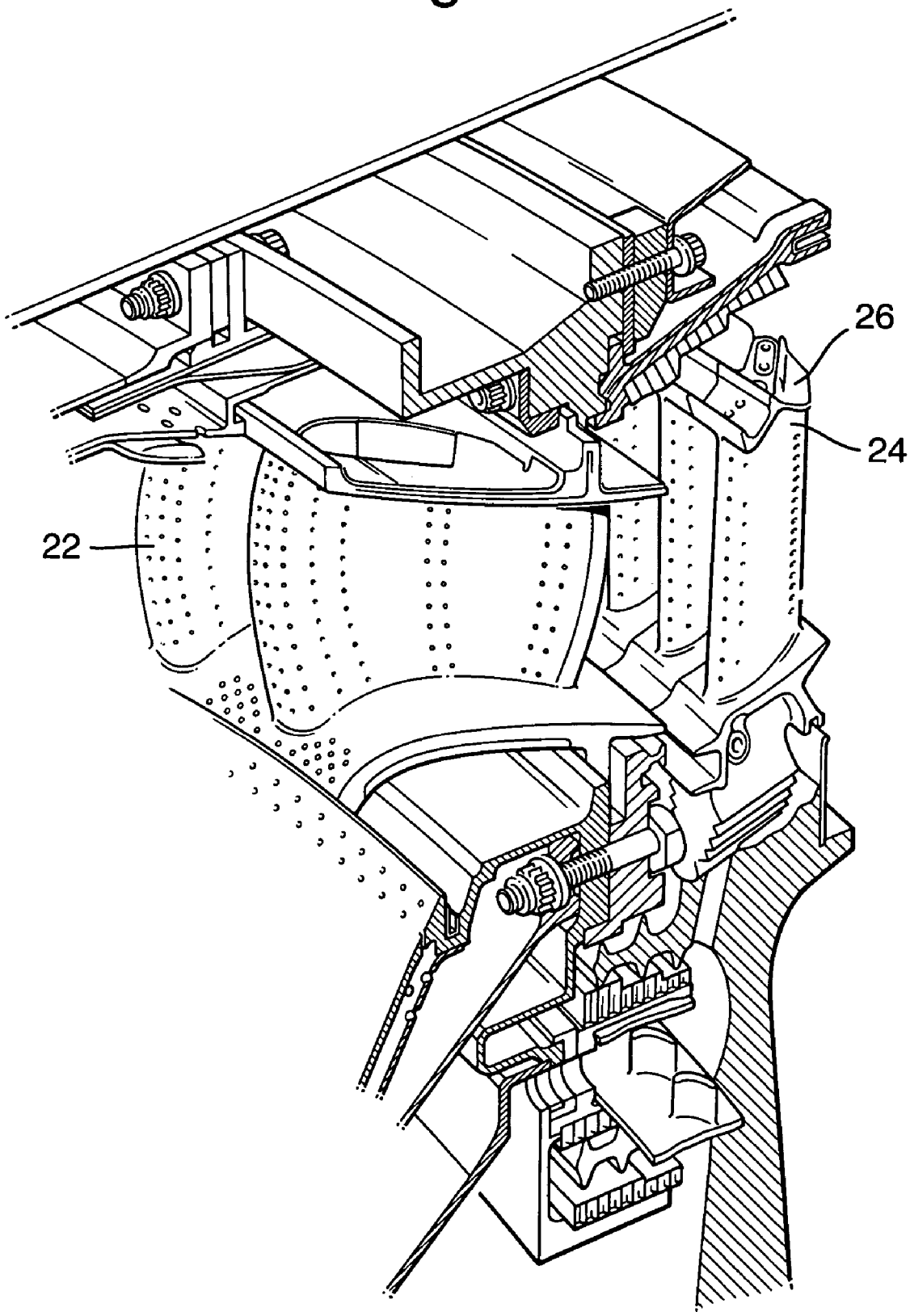
FIG. 2 is a schematic sectional view of a gas turbine engine turbine

Referring to FIG. 2, the turbines typically comprise a set of axially alternating stationary guide vanes 22 and rotatable turbine blades 24—for ease of reference only a section of one set of guide vanes and one set of turbine blades is shown. The guide vanes 22 and turbine blades 24 are mounted generally in a ring formation, with the vanes and the turbine blades extending radially outwardly. For the high pressure turbine, gases expanded by the combustion process in the combustion equipment force their way into discharge nozzles where they are accelerated and forced onto the first guide vane, known as the high pressure nozzle guide vane. The high pressure nozzle guide vane 22 acts as the other guide vanes and imparts a "spin" or "whirl" in the direction of rotation of the turbine blades 24. The gases impact the turbine blades, causing rotation of the turbine.

The gases departing the turbine blades have an exit velocity and an exit angle. The exit angle and velocity are modified by the guide vanes immediately downstream of the turbine blade to provide an optimum efficiency of airflow to the turbine blades. The guide vane between the last high pressure turbine blade and the intermediate pressure turbine blade is known as the intermediate nozzle guide vane (INGV), the guide vane between the last intermediate pressure turbine blade and the low pressure turbine blade is known as the low pressure nozzle guide vane (LPNGV), The torque or turning power applied to the turbine is governed by the rate of gas flow and the energy change of the gas between the inlet and outlet of the turbine blades. The design of the turbine is such that the whirl will be removed from the gas stream so that the flow at the exit from the turbine will be substantially "straightened out" to give an axial flow into the exhaust system. A final outlet guide vane or OGV is therefore situated after the final turbine blade in the low pressure turbine.

A blade shroud 26 is provided to reduce the loss of efficiency through gas leakage across the blade tips. This is made up by a small segment at the tip of each blade which in combination with the other segments forms a peripheral ring.

Figure 3:
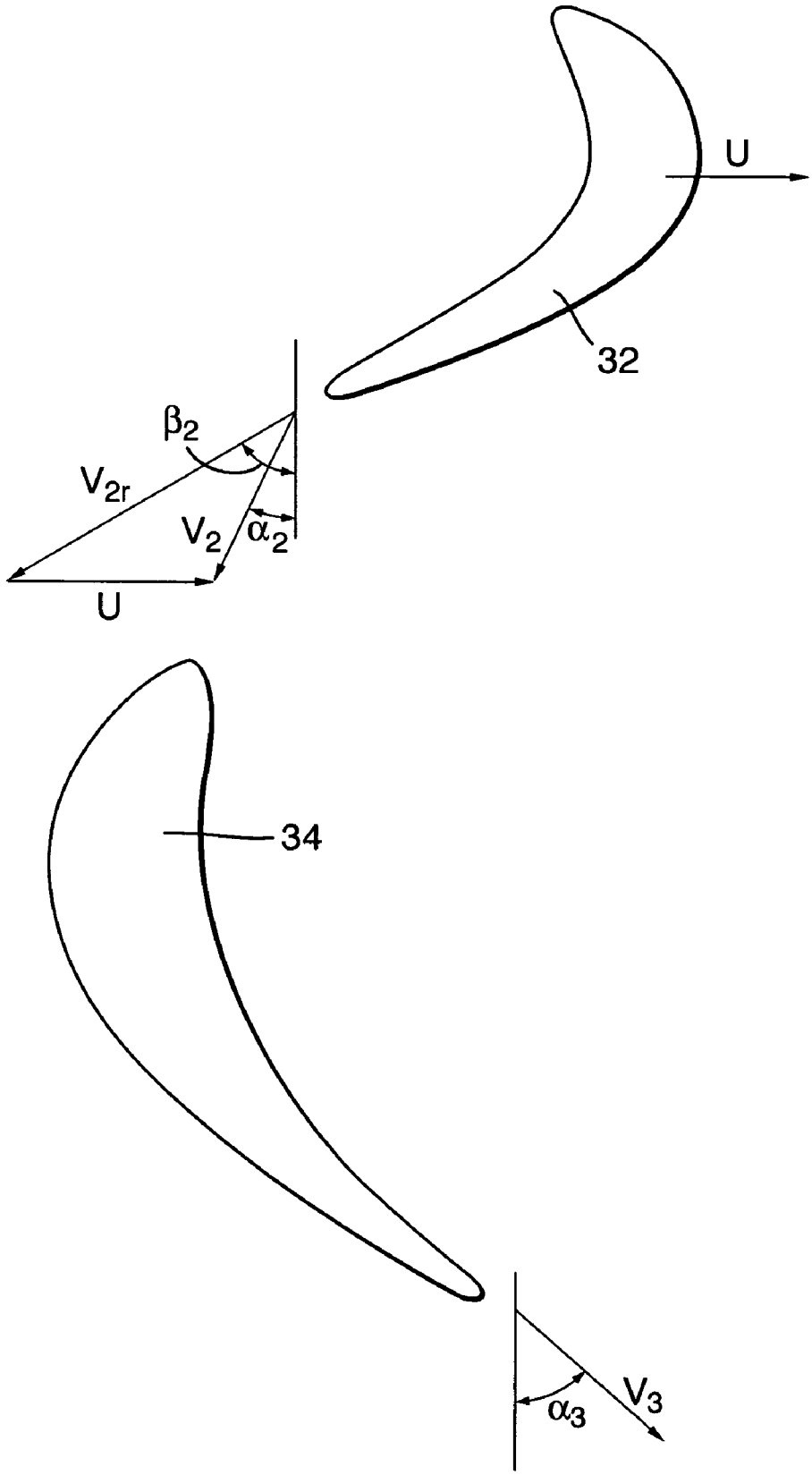
FIG. 3 is a schematic of the vector flows of air from a guide vane and turbine blade at mainstream velocity.

FIG. 3 depicts the final high pressure turbine rotor blade 32 and the intermediate nozzle guide vane 34. A "velocity triangle" for the nominal bulk flow at the exit of the high pressure turbine and before and the intermediate nozzle guide vane is depicted.

The exit flow B from the rotor 32 is at a velocity $V_{2r}$ and an angle, relative to the axis of the engine, of $\beta_2$ in the frame of reference of the rotor. By removing the rotor speed U it is possible to resolve the triangle into the absolute frame of reference where the flow impinges onto the intermediate nozzle guide vane at velocity $V_2$ and angle $\alpha_2$, the zero incident condition. The intermediate nozzle guide vane is designed to receive the flow at this angle and velocity such that the flow leaving the guide vane has a velocity $V_3$ and angle $\alpha_3$ in the absolute frame of reference.

Figure 4:
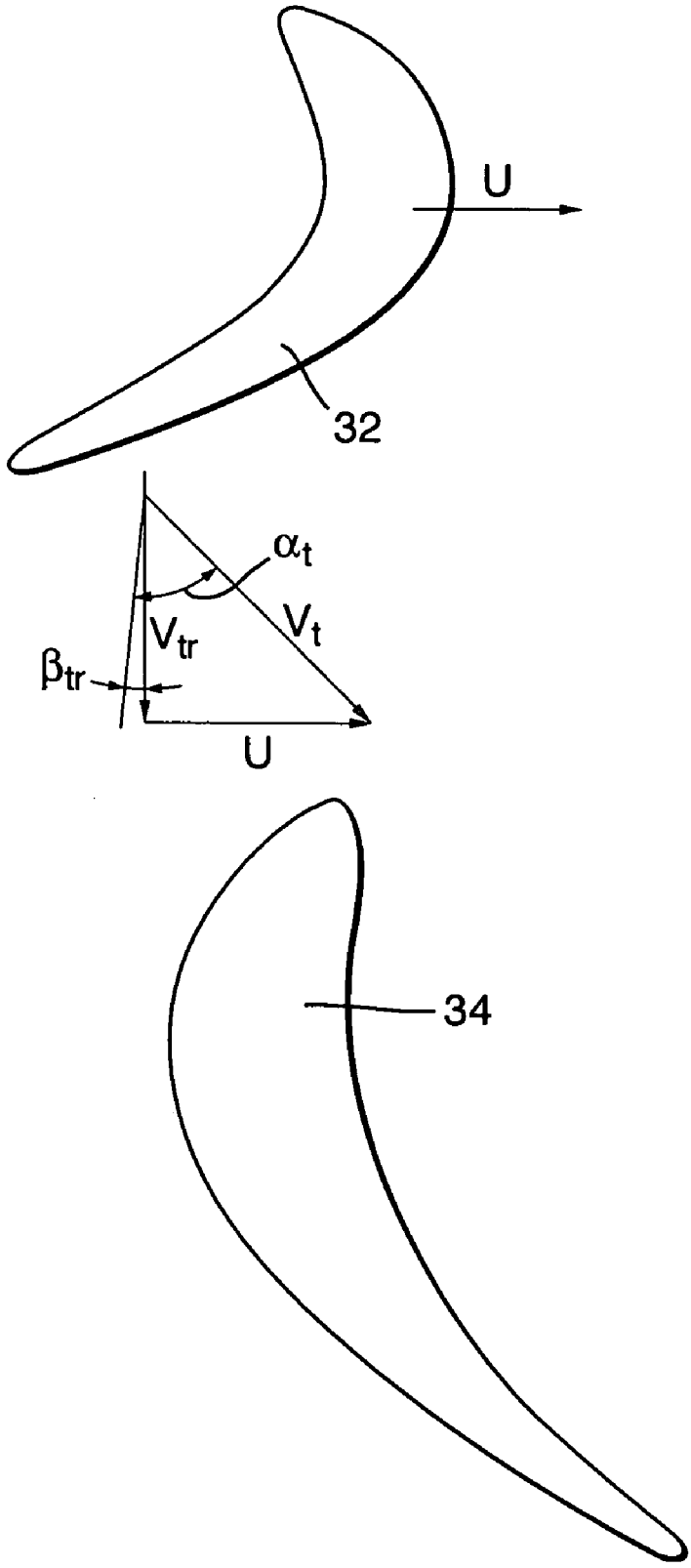
FIG. 4 is a schematic of the vector flows of air flowing over the tip of a turbine blade.

Looking in more detail at the situation at the tip of the rotor, where there is over tip leakage, the flow enters the rotor at the same inlet velocity and angle as the bulk flow but bypasses the aerofoil passage and therefore leaves at a different velocity and angle. This is depicted in the velocity triangle shown in FIG. 4.

In the frame of reference of the rotor, the flow has a velocity $V_{tr}$ and an angle $\beta_{tr}$. Again, removing the blade speed U gives a velocity $V_t$ at an angle $\alpha_t$ in the absolute frame of reference. The angle is algebraically lower than the mainstream flow angle into the intermediate pressure vane, and the angle has a changed sign. The inlet flow to the intermediate pressure vane from the over tip leakage is therefore at negative incidence.

The over tip flow lies adjacent the internal surface of the engine casing and is subject to viscous friction. A proportion of the flow will lose momentum and form a boundary layer. As the boundary layer passes through the intermediate pressure vane passage it experiences the same pressure field as the mainstream flow i.e. high pressure on the pressure surface side, low pressure on the suction surface side of the vane.

Figure 5:
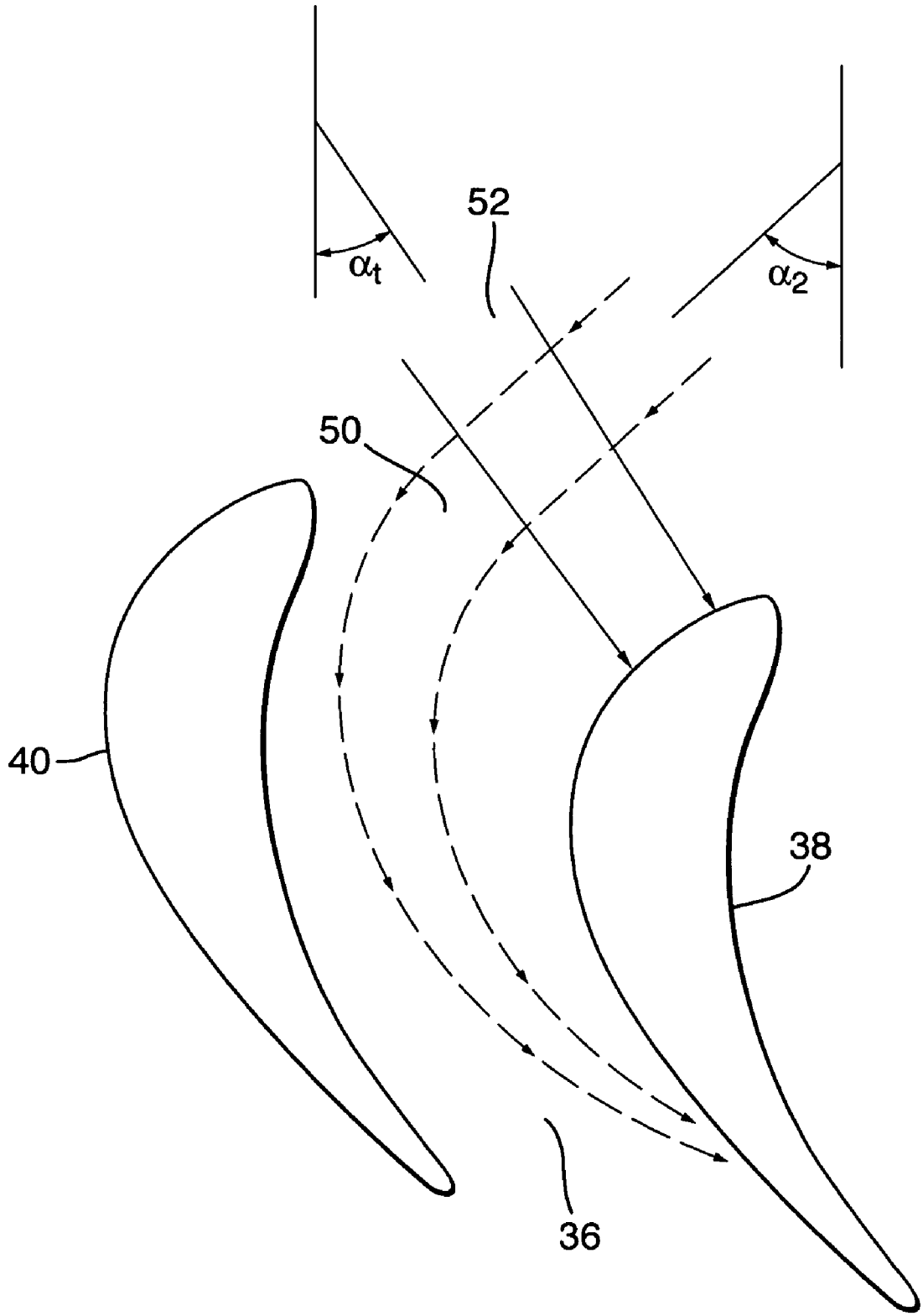
FIG. 5 shows a guide passage and flow of air within the guide passage.

A guide vane passage 36 is formed between two of the guide vanes. Each vane provided with a pressure surface 38 and an opposite suction surface 40. At the mainstream flow velocity the pressure field and the change in tangential momentum are balanced such that the air stream has minimal, or no contact with a suction side of a guide vane and exits the guide vane passage at the required velocity $V_3$ and angle $\alpha_3$. The boundary layer, in contrast, has a lower velocity and momentum than the mainstream flow and, as depicted in FIG. 5, is "overturned" from the pressure side of the passage towards the suction side and onto the suction surface.

In the case where the boundary flow enters the guide vane passage at the mainstream angle $\alpha_2$ it follows the path 50. When it reaches the adjacent aerofoil suction surface it leaves the casing wall and rolls up into what is known as the "outer passage vortex". The outer passage is a source of energy loss and the rotational energy in the vortex cannot be recovered and eventually is dissipated, resulting in an increase to the entropy of the flow.

The path for near-casing over tip flow enters at angle $\alpha_t$ and follows path 52. Relative to the mainstream flow this over tip flow enters at a large negative incidence and is considerably over-turned even at the inlet to the nozzle vane passage. Very early within the passage the flow rolls up into the outer passage vortex, which is much larger than the vortex produced where the entry angle is $\alpha_2$. The energy losses are significantly greater.

Figure 6:
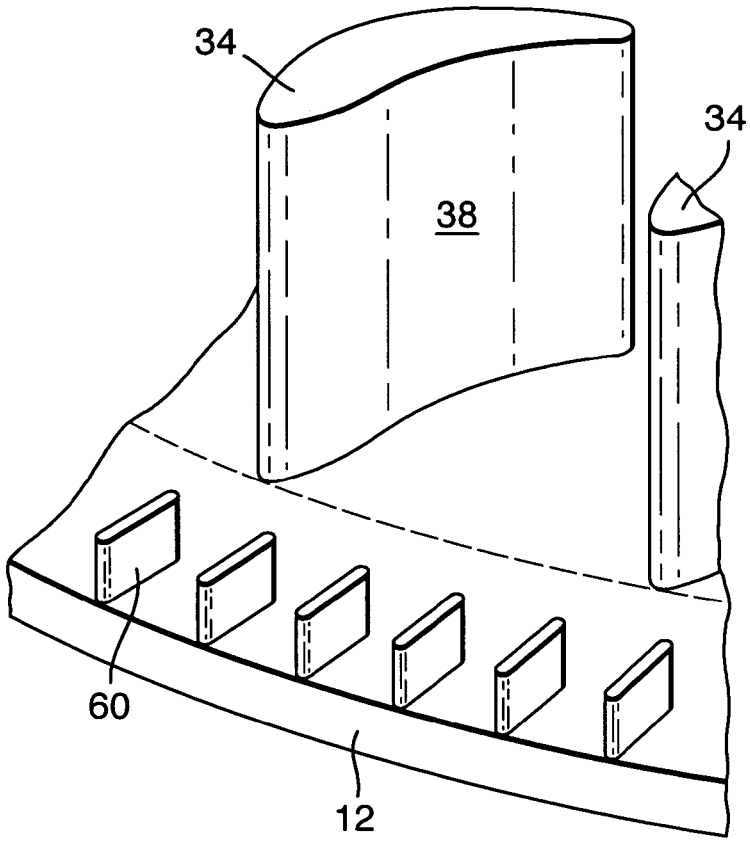
FIG. 6 is a perspective view of baffles according to a first embodiment of the invention
Figure 7:
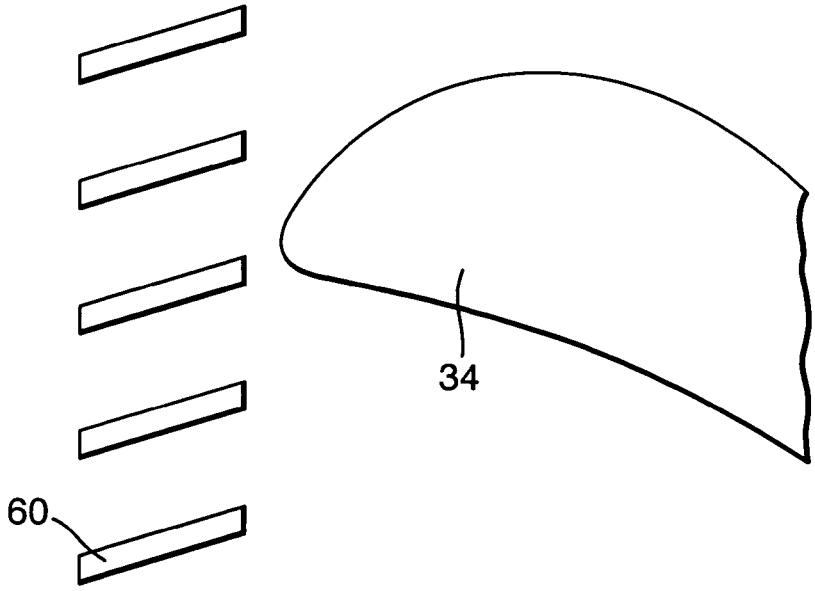
FIG. 7 depicts the arrangement of baffles of FIG. 6

To reduce the angle of the negative incident flow, and consequently the energy losses, an array of projections, protrusions or baffles 60 are formed on the inner surface of the casing as shown in FIG. 6 and FIG. 7. Axially, these are situated before the intermediate pressure nozzle guide vane 34 but after the final high pressure rotor. The baffles are angled with respect to the engine centre line, with an angle similar to the intermediate pressure nozzle guide vane main stream inlet whirl angle near the tip of the blade.

The baffle plates 60 are substantially flat in profile to reduce the tangential momentum component (and hence reduce negative incidence) of the overtip leakage flow before it reaches the intermediate pressure nozzle guide vanes 34. As the baffles are open to the mainstream flow, at best, the flow angle at the boundary layer can be changed to axial.

The tangential momentum component is effectively removed by mixing of the overtip leakage flow with the mainstream flow by the baffles. Although this results in a local loss of energy the overall loss when compared to a turbine without such baffle plates, is reduced.

Figure 8:
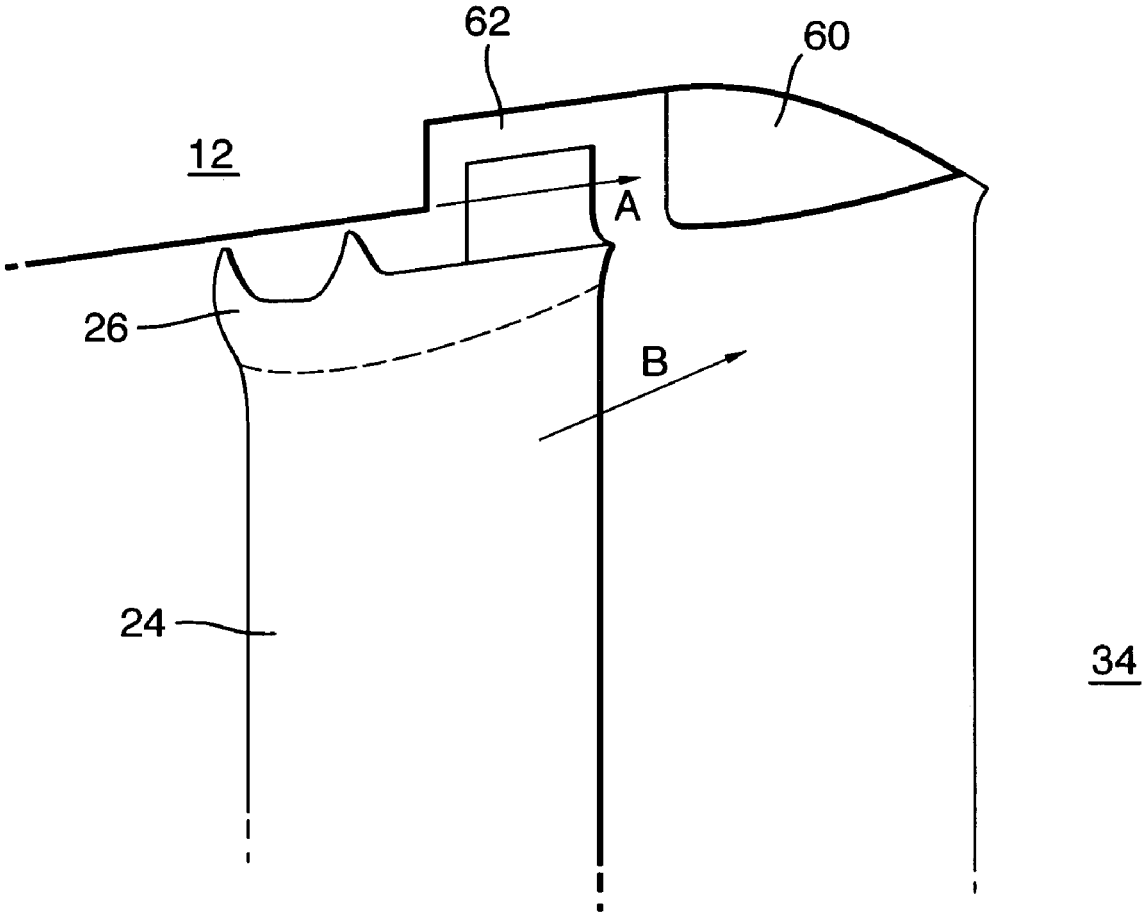
FIG. 8 is a side view illustration of baffle plates and rotor blade according to a second embodiment of the invention.

In an alternative arrangement, described with reference to FIG. 8, projections, protrusions or baffle plates 60 are mounted in a recess 62 formed within the engine casing 12, alternatively the plates may be formed by removal of part of the engine casing. The overtip leakage flow is indicated by arrow A and the mainstream flow indicated by arrow B. In this arrangement there is minimum disturbance to the mainstream flow.

It will be appreciated that whilst the present invention has been described with reference to the transition between the high-pressure turbine and the medium pressure turbine the present invention would be equally applicable between any other area within a gas turbine engine between an area of higher pressure and an area of lower pressure.

It will also be appreciated that the present invention may be used with turbines other than gas turbine engine turbines.

The present invention has been described with reference to the enclosed diagrams. Modifications may be made to the present examples without departing from the invention described herein.

We claim:

1. A turbine of a gas turbine engine comprising:

a fluid inlet and a fluid outlet arranged to pass a main flow of fluid between the inlet and the outlet;

a plurality of axially alternating annular arrays of rotatable aerofoil members and fixed aerofoil members disposed between the fluid inlet and fluid outlet and being mounted within an annular casing having an inner wall and an outer wall, wherein during operation the main flow passes through the rotatable aerofoil members and fixed aerofoil members; and a plurality of radially inwardly extending baffles provided on the inner wall of the casing, the baffles being positioned axially between a selected one of said annular arrays of rotatable aerofoil members and an adjacent annular array of fixed aerofoil members, wherein the selected one of said annular arrays of rotatable aerofoil members is positioned upstream of said adjacent array of fixed aerofoil members such that during operation the main flow exits the selected one of said annular arrays of rotatable aerofoil members and enters the adjacent annular array of fixed aerofoil members at a first angle and a tip leakage flow between the selected one of said annular arrays of rotatable aerofoil members and said inner wall enters the adjacent annular array of fixed aerofoil members at a second angle that is adjusted by the baffles, the baffles being sized to adjust the second angle of the tip leakage flow, and wherein the baffles being substantially flat in profile and being angled with respect a center line of the turbine such that a tangential momentum component of the tip leakage fluid flow is reduced or removed before the tip leakage fluid flow reaches the adjacent annular array of fixed aerofoil members.

2. A turbine according to claim 1, wherein the turbine is part of a gas turbine engine comprising a high pressure turbine in communication with an intermediate pressure turbine and wherein the selected annular array of rotatable aerofoil members forms part of the high pressure turbine.

3. A turbine according to claim 2 wherein the adjacent annular array of fixed aerofoil members forms part of the intermediate pressure turbine of said gas turbine.

4. A turbine according to claim 1, wherein the turbine comprises an annular array of intermediate pressure nozzle guide vanes comprising the adjacent annular array of fixed aerofoil members.

5. A gas turbine engine including a turbine as claimed in claim 1.

6. A turbine according to claim 1, wherein each baffle having a free end.

7. A turbine according to claim 1, wherein each baffle having a free end open to a mainstream flow through the turbine during operation.

8. A turbine according to claim 1, comprising a greater number of baffles than guide vanes.

9. A turbine of a gas turbine engine comprising:

a fluid inlet and a fluid outlet and arranged to pass a main flow of fluid between the inlet and the outlet;

a plurality of axially alternating annular arrays of rotatable aerofoil members and fixed aerofoil members disposed between the fluid inlet and fluid outlet and being mounted within an annular casing having an inner wall and an outer wall, wherein during operation the main flow passes through the rotatable aerofoil members and fixed aerofoil members; and a plurality of radially inwardly extending baffles provided on the inner wall of the casing, the baffles positioned axially between a selected one of said annular arrays of rotatable aerofoil members and an adjacent annular array of fixed aerofoil members, wherein the selected one of said annular arrays of rotatable aerofoil members is positioned upstream of said adjacent array of fixed aerofoil members, wherein each of the rotatable aerofoil members comprise a blade having a tip, wherein the tip is spaced from the inner casing wall a distance that is substantially similar to the distance the baffles extend radially from the inner casing wall such that during operation the main flow exits the selected one of said annular arrays of rotatable aerofoil members and enters the adjacent annular array of fixed aerofoil members at a first angle and a tip leakage flow between the selected one of said annular arrays of rotatable aerofoil members and said inner wall enters the adjacent annular array of fixed aerofoil members at a second angle that is adjusted by the baffles, the baffles being sized to adjust the second angle of the tip leakage flow, and wherein the baffles being substantially flat in profile and being angled with respect a center line of the turbine, such that a tangential momentum component of the tip leakage fluid flow is reduced or removed before the tip leakage fluid flow reaches the adjacent annular array of fixed aerofoil members.

10. A turbine of a gas turbine engine comprising:

a fluid inlet and a fluid outlet and arranged to pass a main flow of fluid between the inlet and the outlet;

a plurality of axially alternating annular arrays of rotatable aerofoil members and fixed aerofoil members disposed between the fluid inlet and fluid outlet and being mounted within an annular casing having an inner wall and an outer wall, wherein during operation the main flow passes through the rotatable aerofoil members and fixed aerofoil members; and a plurality of radially inwardly extending baffles provided on the inner wall of the casing, the baffles positioned axially between a selected one of said annular arrays of rotatable aerofoil members and an adjacent annular array of fixed aerofoil members, wherein the selected one of said annular arrays of rotatable aerofoil members is positioned upstream of said adjacent array of fixed aerofoil members, wherein said baffles are mounted within a recess formed within the inner wall of the casing such that during operation the main flow exits the selected one of said annular arrays of rotatable aerofoil members and enters the adjacent annular array of fixed aerofoil members at a first angle and a tip leakage flow between the selected one of said annular arrays of rotatable aerofoil members and said inner wall enters the adjacent annular array of fixed aerofoil members at a second angle that is adjusted by the baffles, the baffles being sized to adjust the second angle of the tip leakage flow, and wherein the baffles being substantially flat in profile and being angled with respect a center line of the turbine, such that a tangential momentum component of the tip leakage fluid flow is reduced or removed before the tip leakage fluid flow reaches the adjacent annular array of fixed aerofoil members.

11. A turbine according to claim 10, wherein the recess extends radially from the inner wall of the casing towards the outer wall of the casing.

12. A turbine according to claim 10 wherein each of the rotatable aerofoil members comprise a blade having a tip and wherein the tip is positioned within said recess.

13. A method of reducing tip leakage in a turbine of a gas turbine engine having a fluid inlet and a fluid outlet, a plurality of axially alternating annular arrays of rotatable aerofoil members and fixed aerofoil members mounted between the fluid inlet and fluid outlet and within an annular casing having an inner wall and an outer wall, the method comprising:

operating the gas turbine engine to provide a main flow of fluid through the plurality of axially alternating annular arrays of rotatable aerofoil members and fixed aerofoil members, and produce a tip leakage flow between a selected one of said annular arrays of rotatable aerofoil members and the inner wall which flows into an adjacent annular array of fixed aerofoil members; and providing a plurality of radially inwardly extending baffles provided on the inner wall of the casing positioned axially between a selected one of said annular arrays of rotatable aerofoil members and an adjacent annular array of fixed aerofoil members such that the main flow exits the selected one of said annular arrays of rotatable aerofoil members and enters the adjacent annular array of fixed aerofoil members at a first angle and the tip leakage flow enters the adjacent annular array of fixed aerofoil members at a second angle that is adjusted by the baffles such that a tangential momentum component of the tip leakage fluid flow is reduced or removed before the tip leakage fluid flow reaches the adjacent annular array of fixed aerofoil members.

* * * * *